United States Patent [19]

Seery

[11] Patent Number: 5,038,960

[45] Date of Patent: Aug. 13, 1991

[54] FLEXIBLE LINER SYSTEM FOR TANKERS

[76] Inventor: John T. Seery, 4821 Winchester, Claremore, Okla. 74017

[21] Appl. No.: 620,770

[22] Filed: Dec. 3, 1990

[51] Int. Cl.[5] ..... B65D 88/16

[52] U.S. Cl. ..... 220/403; 220/401; 220/855

[58] Field of Search ..... 220/403, 410, 412, 461, 220/85 A, 85 B, 85 F, 853, 905

[56] References Cited

U.S. PATENT DOCUMENTS

| | | | |
|---|---|---|---|
| 3,606,958 | 9/1971 | Coffman | 220/461 |
| 4,230,061 | 10/1980 | Roberts et al. | 220/461 |
| 4,461,402 | 7/1984 | Fell et al. | 220/461 |
| 4,585,052 | 4/1986 | Kaneko et al. | 220/461 |
| 4,625,892 | 12/1986 | Carlin, Jr. | 220/461 |
| 4,738,356 | 4/1988 | Gunkel et al. | 220/461 |
| 4,852,765 | 8/1989 | Lyzohub | 220/461 |

*Primary Examiner*—Joseph M. Moy
*Attorney, Agent, or Firm*—Head & Johnson

[57] ABSTRACT

A liner apparatus for a tanker having at least one storage compartment and at least one tubular pipe extending into said compartment for conducting a liquid or gas. The liner apparatus includes an elastomeric, resilient liner contiguous with at least a portion of the storage compartment. A mounting bracket has an opening to receive the pipe therethrough and is suspended from the pipe. A fluid and gas impermeable flexible bladder within the storage compartment has an opening to receive the pipe. The flexible bladder is sealably attached to the mounting bracket, whereby spillage of the liquid or escape of the gas from the bladder will be prevented.

4 Claims, 6 Drawing Sheets

FLEXIBLE LINER SYSTEM FOR TANKERS

BACKGROUND OF THE INVENTION

1. Field of the Invention

The present invention relates to a tanker liner system to prevent spillage of liquids in the event the hull of a tanker is damaged in an accident and to prevent fire or explosion due to the escape of gases from the storage material.

2. Prior Art

Recently, oil spills from tankers have become a major problem. Tanker accidents not only result in loss of the cargo but damage to the marine environment. Both the size and the frequency of the spills have dramatized the need for solutions to the problem.

A recent proposal has been to install double hulls on all ships, with a space provided between the hulls. If the exterior hull is ruptured, the integrity of the cargo would be maintained. This proposal is expensive and cuts down on the amount of usable storage space. It has been estimated that the tanker cost would increase 15 to 30 per cent.

An additional problem not solved by double hull tankers is the possibility of hydrocarbon or toxic vapors escaping or being allowed to combust with oxygen to produce a fire.

Presently, empty crude tankers will have their storage compartments filled with inert gases to prevent a buildup of dangerous hydrocarbon gases from the residue of previous cargoes.

Vapor control systems at dock side are increasingly being required to handle the vapors which are retained in the cargo areas.

The present invention would introduce a liner system to decrease the likelihood of spillage during a tanker accident and reduce the probability of explosion or fire from escaping gases.

A cost effective solution would be provided to a major environmental issue by reducing tanker spills, by increasing safety in transporting volatile products and by eliminating discharge of hydrocarbon vapors into the atmosphere.

Applicant has conducted a search and is aware of the following patents:

| U.S. Pat. No. | Inventor |
|---|---|
| 3,664,904 | Cook |
| 4,239,416 | Borca et al. |
| 4,516,692 | Croley |
| 4,653,663 | Holtsclaw |
| 4,863,339 | Krein |
| 4,930,661 | Voorhies |
| 4,941,589 | Chen |

The Cook patent discloses a self-sealing structure adapted for use in a container as a fluid barrier. The structure comprises a sealant material adapted to swell in the presence of certain fluids and is interposed between inner and outer layers.

The Borca et al. patent discloses a device used to line a cavity in the earth such as a reservoir or tunnel. The lining is a flexible, fluid impervious sheet, such as rubberized fabric supported by a gridlike skeleton structure which when under tension presses the liner against the walls of the cavity.

The Croley patent discloses a disposable container assembly useful for containing and shipping liquids or semi-liquids in bulk. It comprises of fiber board container body secured to a pallet in the upright position. A bag is contained within the interior of the structure containing a dispensing spout locked in a dispensing position on one side of the container.

The Holtsclaw patent discloses a clamping assembly used to secure a flexible liner to a storage tank. The device comprises a filling pipe and a venting pipe passing through a mounting plate attached to the outside of a storage tank.

The Krein patent discloses a method for positioning a waterproof liner in a semi-truck trailer container. A negative pressure is allowed to form in the space between the bag and the inner walls of the container causing the sides of the liner to move toward the sides of the container.

The Voorhies patent discloses a disposable container formed of corrugated paper material containing a molded plastic inner tank positioned upright in the container.

The Chen patent discloses a device for lining the inner surface of a cargo container. The device includes a flexible bag which outlines the entire inner surface wall of the cargo container and magnetic elements holding the bag against the inner surface of the wall. The device is designed to prevent the flexible bag from collapsing within the cargo container.

Accordingly, it is a principal object and purpose of the present invention to provide a liner apparatus to reduce the potential of spills from tankers and to reduce the venting of hydrocarbons or other toxic vapors from a tanker cargo into the atmosphere.

It is a further object and purpose of the present invention to provide a liner apparatus to absorb the impact in the event of rupture of the hull of a tanker while retaining the liquid cargo.

SUMMARY OF THE INVENTION

The present liner system is adapted for use with a tanker or vessel having an exterior hull with a number of individual storage compartments within the tanker.

Piping for conducting a liquid cargo is directed past the valves and then into the individual storage compartments.

According to the present invention, an elastomeric, resilient liner is placed within each storage compartment and covers at least the portion thereof. The liner includes a relatively thick rubber or rubber-like lining. Contiguous around the exterior of the lining 54 is a shell that may be attached at periodic intervals to the hull or to stiffeners extending from the hull through use of fasteners.

Bumpers in the form of ribs may extend from the shell and rest on the interior of the hull. The bumpers may be secured to the shell by fasteners.

Interior to the elastomeric liner is a flexible, fluid and gas impermeable bladder. The bladder is not affixed to the liner or the storage compartment. Rather, the liquid will expand the bladder out to fill the space of the storage compartment. Conversely, the bladder is free to collapse within the storage compartment when the liquid cargo is removed.

A cable retaining ring may be secured to the bladder in order to assist in initial installation or in removal of the bladder from the storage compartment.

The piping which conducts the liquid cargo extends through the opening in the bladder. A mounting bracket, including a pair of steel flange plates, retains reinforcing material therebetween. Sandwiched between the reinforcing material is the bladder. Accordingly, a seal is maintained around the piping.

DETAILED DESCRIPTION OF THE PREFERRED EMBODIMENTS

Figure 1:
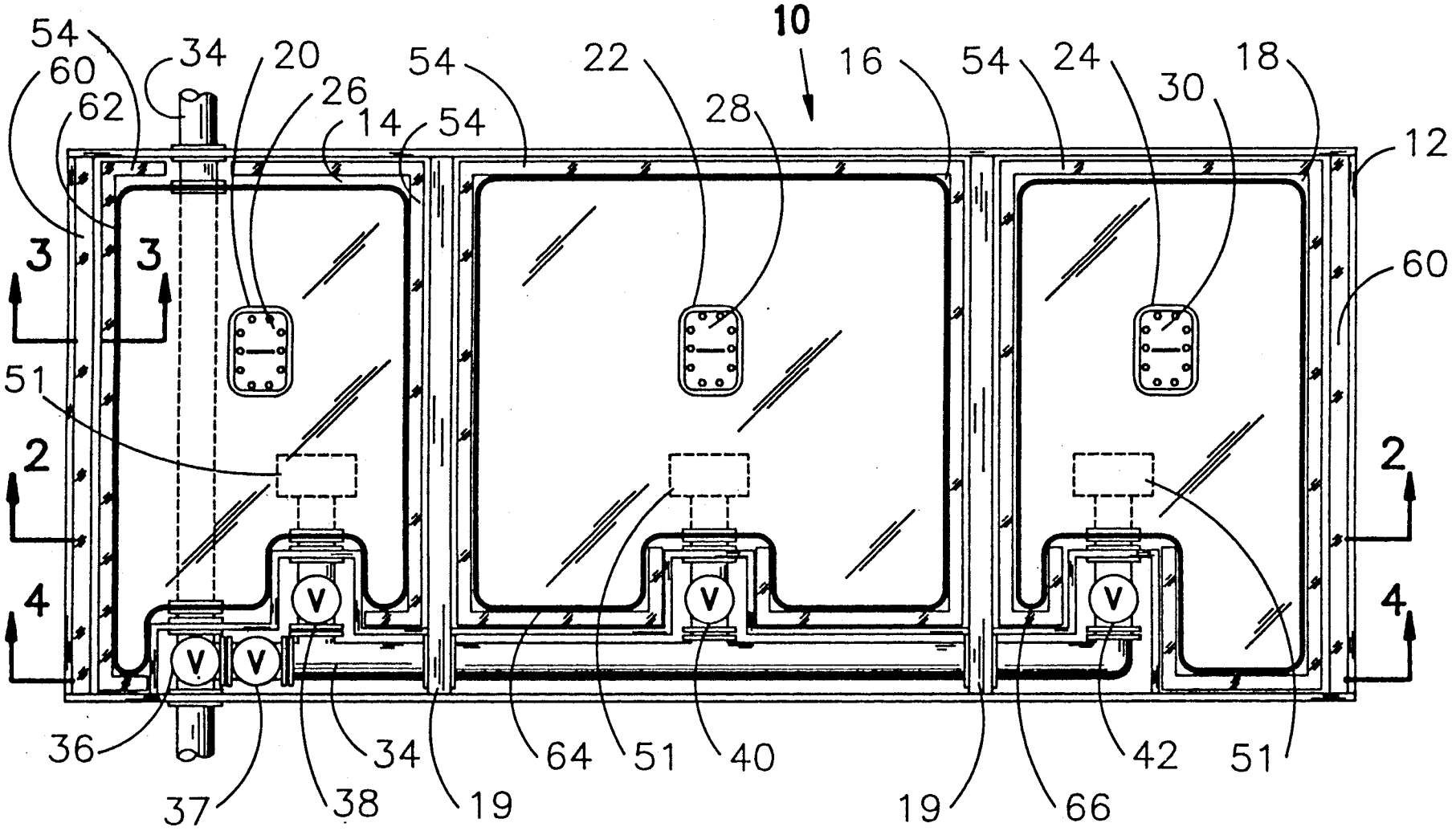
FIG. 1 is a partial top plan view of a tanker incorporating the flexible liner system of the present invention.
Figure 2:
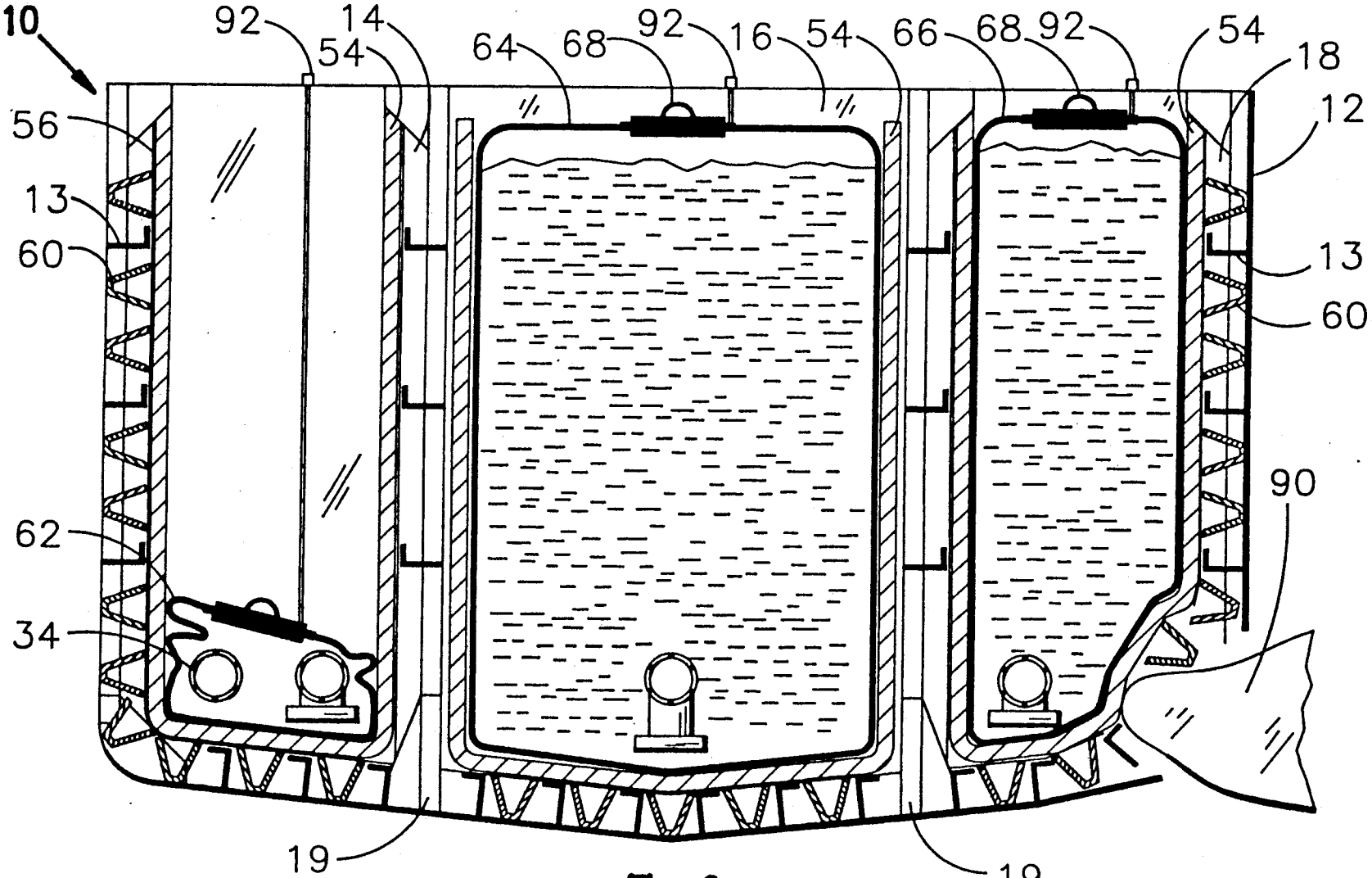
FIG. 2 is a sectional view taken along section line 2—2 of FIG. 1.

Referring to the drawings in detail, FIG. 1 shows a top partial view of a typical vessel or tanker 10 incorporating the present invention. FIG. 2 illustrates a sectional view taken along section line 2—2 of FIG. 1. The tanker includes an exterior metal hull 12, typically one and one-half inches thick or less, which may include struts or stiffeners 13 to add strength to the hull. The design of the particular tanker may vary from unit to unit, although the design shown is typical.

Over the years, the size of these tankers has increased up to the "super-tankers"- often 200,000 tons or more.

A large number of storage compartments within the tanker 10 are used to handle a large variety of liquid cargo from liquid hydrocarbons, such as oil, to various chemicals. Three separate storage compartments 14, 16, and 18 are shown. The individual storage compartments may be separated by bulkheads 19.

Prior to the present invention, liquid cargo would be stored in and be removed from the storage compartments themselves. When removing liquid cargo from a storage compartment, a vent opening (not shown) would allow atmospheric air to enter the storage compartment to replace the liquid removed. A small amount of residue from the liquid cargo is typically left in the storage compartment, some of which may be vaporized. Upon refilling with liquid cargo, the air within the storage compartment would be forced out of the vent. The air with vaporized liquid would then be released to the atmosphere or processed.

Each of the storage compartments 14, 16 and 18 includes a manway 20, 22, and 24, respectively, for access to the storage compartments. The manways may be closed by hatches 26, 28, and 30, respectively. Piping 34 for conducting the liquid cargo 35 is directed past a series of valves 36 and 37 and then into the individual storage compartments 14, 16, and 18 past compartment valves 38, 40 and 42, respectively. Each valve may be moved between an open and closed position by use of a wheel or handle 44 (not seen in FIGS. 1 or 2). The valves may be of various types, such as gate valves, check valves, or ball valves. Pumping machinery of known design would be included.

The foregoing describes the tanker or vessel itself prior to introduction of the present invention.

The piping 34 passes through and is retained by mounting brackets 46, 48, and 50, to be described in detail. Each piping section terminates in a filter or strainer 51.

Figure 3:
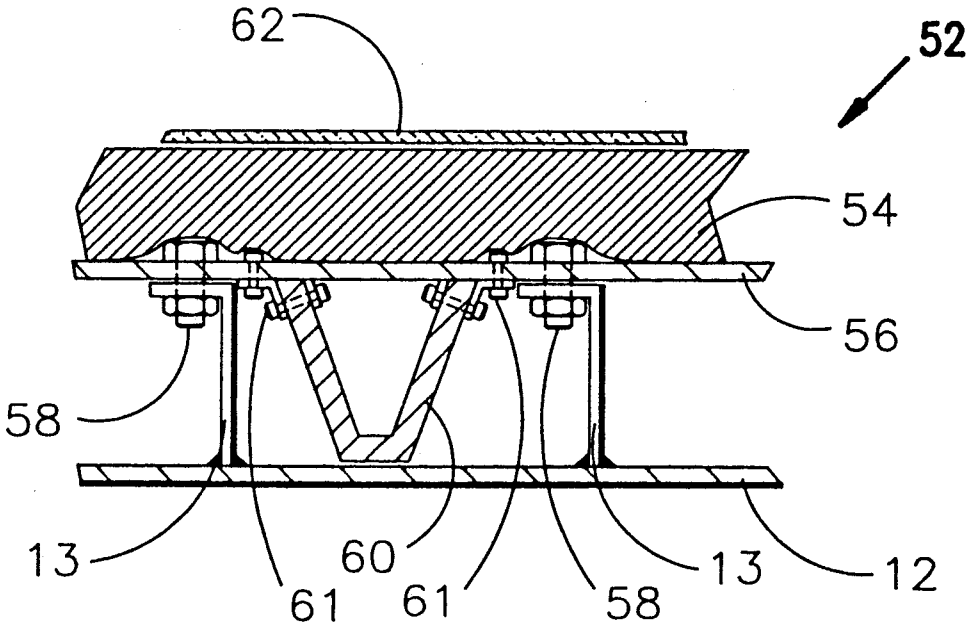
FIG. 3 is a sectional view taken along section line 3—3 of FIG. 1.

An elastomeric, resilient liner 52 is placed within each storage compartment and covers at least a portion thereof. The liner 52, as best seen in the partial sectional view of FIG. 3, includes a relatively thick rubber or synthetic rubber-like lining 54. Contiguous along the exterior of the lining 54 is a sheet metal shell 56 which may be attached at periodic intervals to the hull or frame stiffeners 13 extending from the hull 12 through use of fasteners 58. Additionally, bumpers in the form of ribs 60 may extend from the shell 56 and rest on the interior of the hull 12. The ribs 60 may be secured to the shell 56 by fasteners 61.

Interior to the elastomeric liner 52 within the storage compartments are flexible bladders 62, 64 and 66 which are tear resistant and fluid and gas impermeable. The composition of the bladders would be such as to provide strength and cut and tear resistance.

A tape gauge 92 might also be attached at the top of each bladder so that it could readily be determined how full the bladder is.

Figure 4:
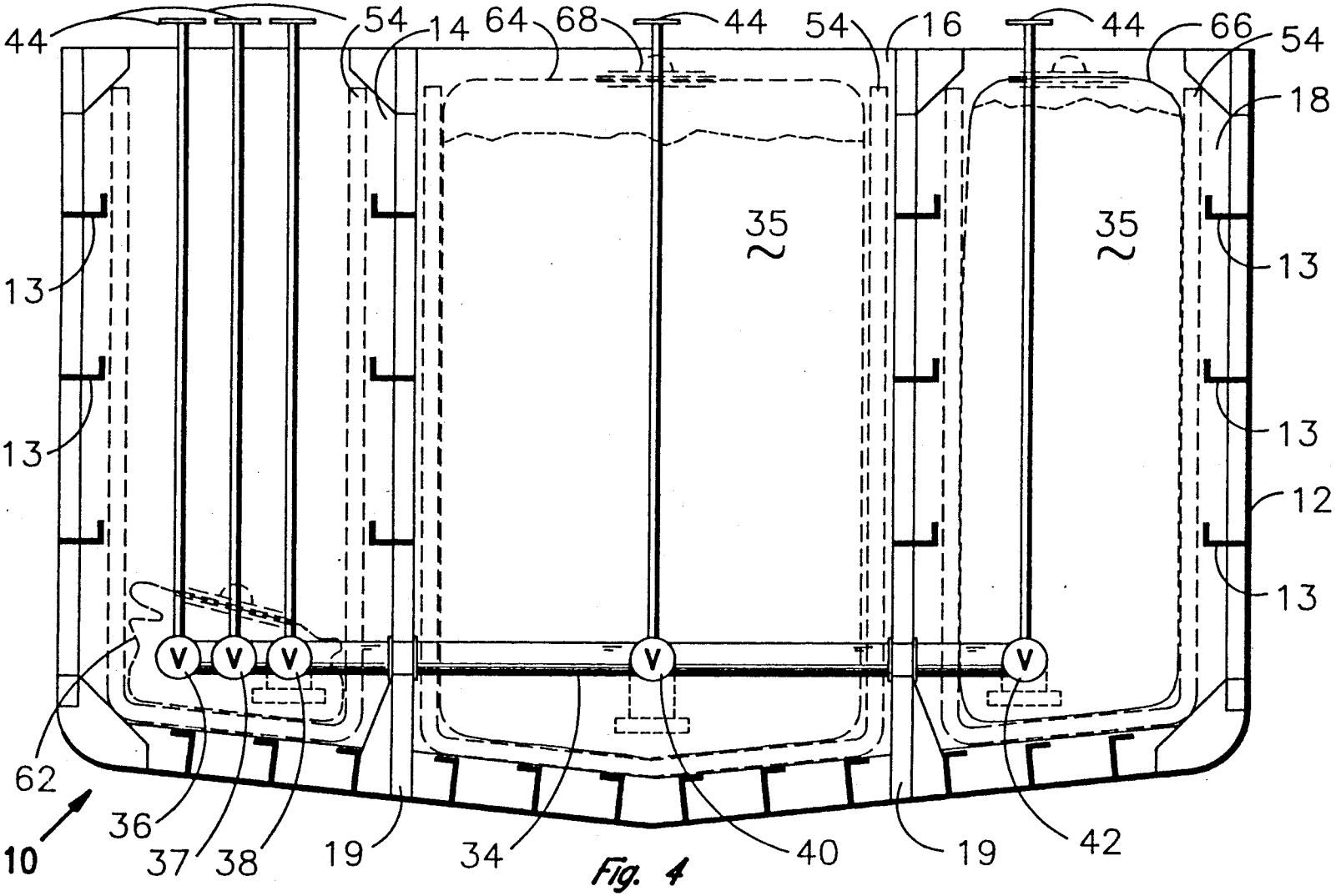
FIG. 4 is a sectional view taken along section line 4—4 of FIG. 1.

FIG. 4 shows a partial sectional view taken along section lines 4–4 of FIG. 1. It will be observed that the bladders 62, 64 and 66 are not affixed to the storage compartments 14, 16 and 18 or the liner 52 but, rather, the liquid cargo 35 will push the bladder out to fill the space of the storage compartments. Conversely, as observed with bladder 62 in FIGS. 2 and 4, the bladder is free to collapse when the liquid cargo 35 has been removed. Any residue of the liquid cargo remains in the bladder 62 and is not free to mix with atmospheric air. The storage compartment 14 would be vented to allow atmospheric air to enter the storage compartment without entering the bladder 62.

Figure 5:
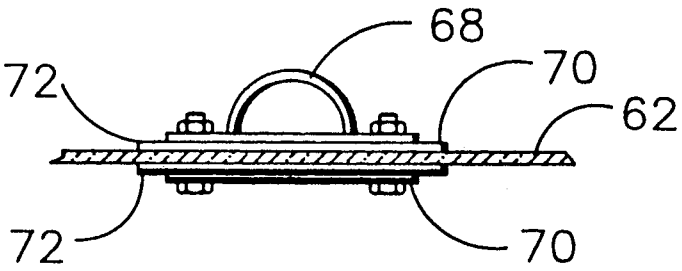
FIG. 5 is a cable hook attachment for attachment of the bladder of the liner system shown in FIG. 1.

FIG. 5 shows an enlarged view of a retaining ring 68 that may be secured to the bladder 62 through use of a pair of steel flange plates 70 which retain a pair of reinforcing material sheets 72. Pressed between the sheets of reinforcing material is the bladder 62. Accordingly, the bladder 62 may be installed in or removed from the storage compartment by attaching a hook (not shown) to the ring.

Figure 6:
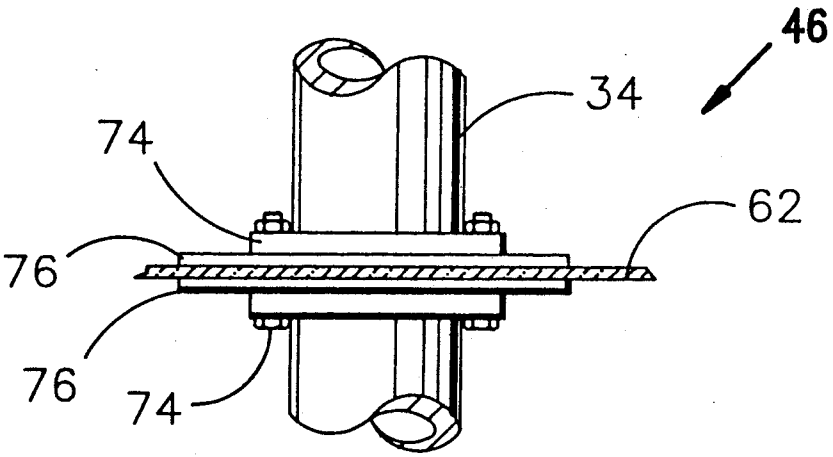
FIG. 6 is a mounting bracket for the bladder of the liner system shown in FIG. 1.

FIG. 6 shows an enlarged view of one of the mounting brackets 46. The piping 34 extends through a opening in the bladder 62. A pair of steel flange plates 74 retain a pair of reinforcing material sheets 76 in place. Sandwiched between the sheets of reinforcing material 76 is the bladder 62. Accordingly, a seal is maintained around the piping 34. The use of the reinforcing material assists in preventing stresses on the bladder from tearing the bladder from the mounting bracket.

Figure 7:
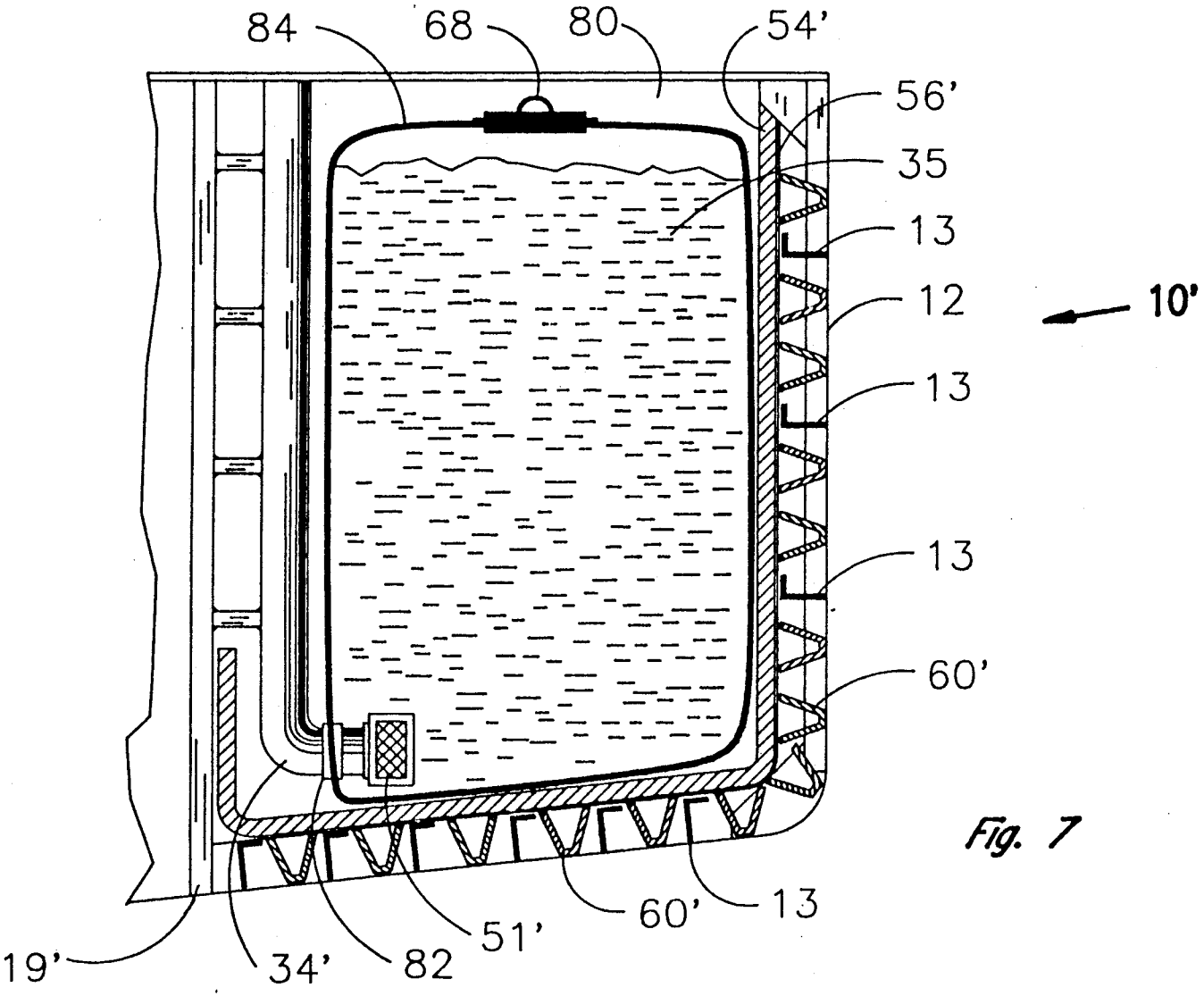
FIG. 7 is a modification of the present invention to be utilized with a storage compartment having piping arranged in an alternate manner.

Modifications may be made to adapt the invention to various tanker storage compartments. FIG. 7 shows the liner system 10' in use with a storage compartment 80 wherein the piping 34' is brought to the storage compartment from above. The ribs 60' shell 56', and lining 54' are easily adapted. The mounting bracket 82 operates in the same manner as previously described to sealably affix the bladder 84 to the piping 34'.

Figure 8:
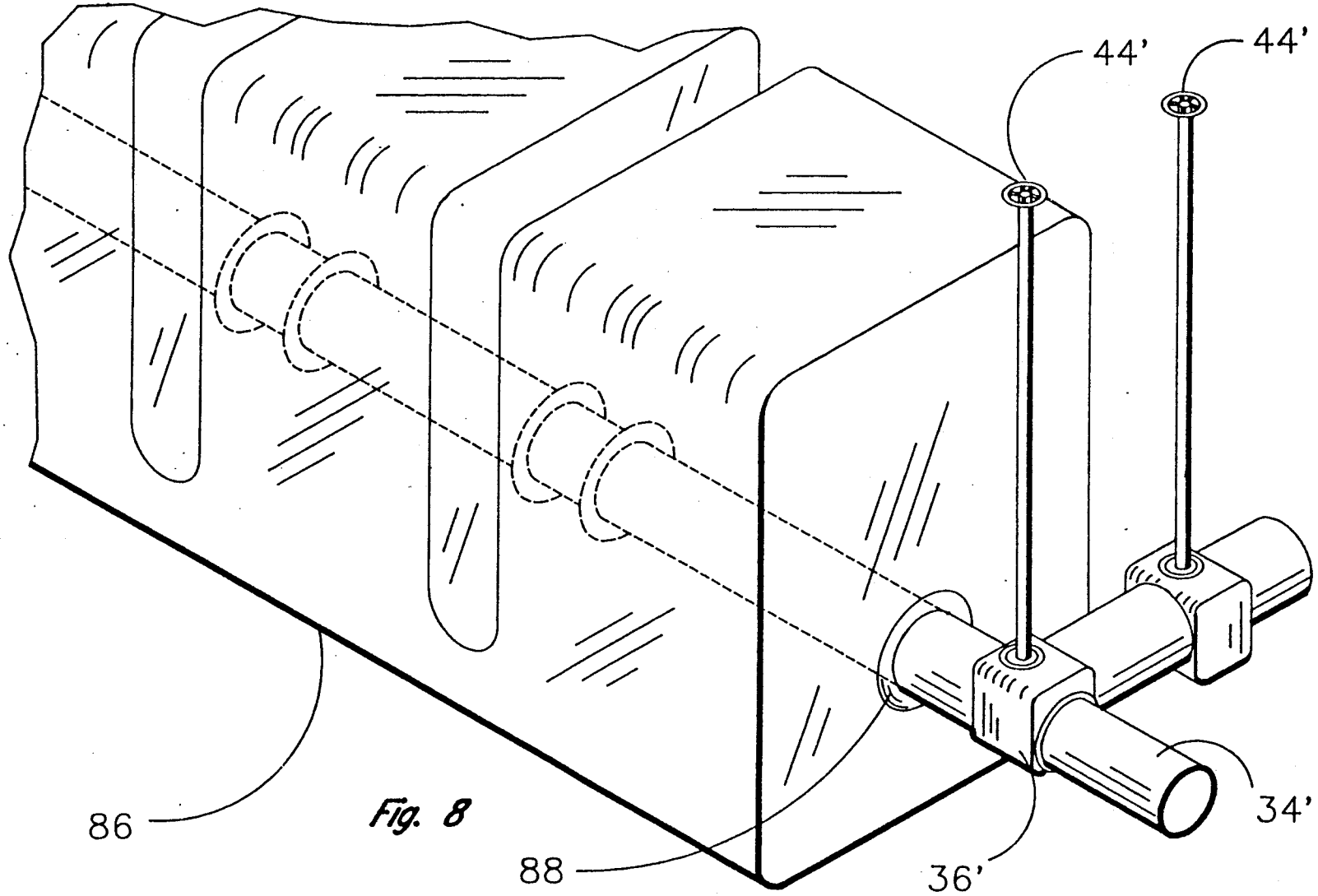
FIG. 8 is a modification of the present invention showing a bladder used for several storage compartments.

FIG. 8 illustrates a further modification. The individual storage compartments (not shown) may not be segmented entirely by bulkheads (not shown). In that event, single bladder 86 may be used for a number of storage compartments. Mounting brackets 88 allow piping 34' to pass through the bladder 86.

In order to illustrate the value of the present invention, FIG. 2 has been amended to illustrate the effect of an impact of the tanker 10 on an obstruction 90 such as a reef or rocks.

Assuming that the integrity of the hull 12 is breeched, the elastomeric resilient liner 52 which includes ribs 60 and lining 54 will absorb the initial impact of the collision. The liner 52 will also spread the force of the impact. Even if the ribs 60 and lining, 54 are damaged, the flexible bladder 66 will remain intact and simply deform to any force on it.

A release of the liquid cargo 35 is, thus, prevented or minimized.

The invention 10 is also advantageous to reduce environmental pollution. When the liquid cargo is removed, no atmospheric air is drawn into the bladder, which collapses as the cargo is removed. Accordingly, when the bladder is refilled, no vaporized hydrocarbons or chemicals are released to the atmosphere.

The risk of fire or explosion within the tanker is also reduced because the residue hydrocarbons or other chemicals are not allowed to vaporize.

Whereas the present invention has been described in relation to the drawings attached hereto, it should be understood that other and further modifications, apart from those shown or suggested herein, may be made within the spirit and scope of this invention.

What is claimed is:

1. A liner apparatus for a tanker having at least one storage compartment and at least one tubular pipe extending into said compartment for conducting a liquid or gas, said apparatus comprising:

an elastomeric, resilient liner contiguous with at least a portion of said storage compartment;

mounting bracket means having an opening to receive said pipe therethrough and being suspended from said pipe; and a fluid and gas impermeable flexible bladder within said storage compartment, said bladder having an opening to receive said pipe, said flexible bladder sealably attached to said mounting bracket, whereby spillage of said liquid or escape of said gas from said bladder will be prevented.

2. A liner apparatus as set forth in claim 1 wherein said elastomeric liner includes an outer surface, and including a shell contiguous with said liner, and a plurality of ribs extending from said shell, said ribs resting against the inner surface of said storage compartment.

3. A liner apparatus as set forth in claim 1 wherein said mounting bracket means includes at least a pair of flanges retaining said flexible bladder therebetween.

4. A liner apparatus as set forth in claim 1 wherein said flexible bladder inflates upon filling with said liquid or said gas and deflates upon removing said liquid or said gas, so that no atmospheric air is transferred into said flexible bladder.

* * * * *